US008800244B1

(12) United States Patent
Smarr

(10) Patent No.: US 8,800,244 B1
(45) Date of Patent: Aug. 12, 2014

(54) SYSTEM AND METHOD OF INSTALLING DRYWALL CEILING

(71) Applicant: Jerry W. Smarr, Granite Shoals, TX (US)

(72) Inventor: Jerry W. Smarr, Granite Shoals, TX (US)

( * ) Notice: Subject to any disclaimer, the term of this patent is extended or adjusted under 35 U.S.C. 154(b) by 0 days.

(21) Appl. No.: 13/770,061

(22) Filed: Feb. 19, 2013

(51) Int. Cl.
*E04B 1/00* (2006.01)
*E04G 21/14* (2006.01)
*E04F 21/18* (2006.01)

(52) U.S. Cl.
CPC ..... *E04F 21/185* (2013.01); *E04G 21/14* (2013.01)
USPC ..... 52/745.11; 52/127.6; 52/127.9

(58) Field of Classification Search
USPC ..... 52/745.1, 745.11, 127.1, 127.2, 52/127.5–127.9, 698, 712, 713; 29/525.01; 33/562
See application file for complete search history.

(56) References Cited

U.S. PATENT DOCUMENTS 2,317,428 A * 4/1943 Anderson ..... 52/509
2,799,058 A * 7/1957 Swenson ..... 403/42
3,308,588 A * 3/1967 Von Wedel ..... 52/127.8
3,861,104 A * 1/1975 Bower ..... 52/283
4,448,007 A * 5/1984 Adams ..... 52/489.2
4,449,338 A 5/1984 Reicherts
4,709,460 A * 12/1987 Luhowyj ..... 29/271
4,709,527 A 12/1987 Cooley
4,782,642 A * 11/1988 Conville ..... 52/770
4,995,605 A * 2/1991 Conville ..... 52/770
5,079,888 A * 1/1992 Hileman et al. ..... 52/514
5,224,309 A * 7/1993 Bodell ..... 52/127.1
5,249,405 A * 10/1993 Miller ..... 52/712
5,371,994 A 12/1994 Waters
5,655,337 A 8/1997 Bryant
5,687,528 A * 11/1997 Rouch ..... 52/514
5,775,036 A * 7/1998 Stanley, Sr. ..... 52/127.2
6,131,361 A 10/2000 Murphy
7,578,101 B2 8/2009 Ganske
7,694,464 B2 * 4/2010 Garcia et al. ..... 52/94
8,549,816 B2 * 10/2013 Roberts ..... 52/749.1

* cited by examiner

*Primary Examiner* — William Gilbert
*Assistant Examiner* — Gisele Ford
(74) *Attorney, Agent, or Firm* — Robert C. Montgomery; Montgomery Patent & Design, LLC

(57) ABSTRACT

A system to aid in the installation of drywall or similar items on ceilings or vertical wall surfaces comprises a set of bracket structures. A first pair of brackets is fixed, and a second pair of brackets comprises a pivot screw that is swung in place after the drywall is lifted into place. Each bracket is provided with a mounting fastener adapted to be attached to the ceiling joists or wall studs. Once in place, the drywall is slid into the brackets and held securely in place. The drywall is then fastened into the joists and the brackets can then be removed. The brackets are spun around or reinstalled and the process repeated as needed.

13 Claims, 4 Drawing Sheets

SYSTEM AND METHOD OF INSTALLING DRYWALL CEILING

RELATED APPLICATIONS

There are no current co-pending applications.

FIELD OF THE INVENTION

This disclosure relates to drywall installation accessories and, more particularly, to a system and method for aiding in drywall installation on vertical wall surfaces and horizontal ceiling surfaces.

BACKGROUND OF THE INVENTION

Drywall consists of a thin layer of gypsum sandwiched between two (2) layers of heavy paper. It is commonly used in residences and buildings to cover walls and ceilings, because it is both faster and cheaper to install than plaster. Drywall panels are manufactured in standard sizes, commonly of four-by-eight feet rectangular dimensions. Due to their size and weight, these panels are both wearying and cumbersome to fasten them to either vertical framing studs or horizontal ceiling joists.

Drywall installation is a tiresome job requiring a great deal of physical work. Drywall sheets are heavy and must usually be carried manually to their final position. This work is magnified if the drywall sheets are installed on ceilings. Such installations usually require three (3) workers to do; two (2) workers to place and hold the drywall at either end and the third worker to drive drywall screws or pound nails. This work requires multiple ladders as well and subjects the workers to off-balance positions, possible falls, and associated ergonomic injuries. Other solutions involve drywall jacks or holding "T's" that may reduce manpower, but are still difficult, costly, and cumbersome to use. Accordingly, there exists a need for a means by which drywall and similar materials can be installed on ceiling surfaces with a minimum of aggravation, reduced manpower and a reduction in physical exertion.

SUMMARY OF THE INVENTION

In view of the foregoing disadvantages inherent in the prior art, it has been observed that there is need for a drywall installation system including a plurality of pivoting brackets removably attached to existing joists located at a horizontal ceiling surface within an existing structure, and a plurality of fixed brackets removably attached to existing joists located at a vertical wall surface within the existing structure. Advantageously, the pivoting brackets enable a user to install an existing first drywall section at the horizontal ceiling surface while the fixed brackets enable a user to install an existing second drywall section at the vertical wall surface. Preferably, each of the pivoting brackets has a single and unitary body and each of the fixed brackets has a single and unitary body.

In a non-limiting exemplary embodiment, each of the pivoting brackets includes a retaining leg and a support leg integral therewith. In this manner, during installation of the existing first drywall section, the retaining leg is positioned at a first orientation capable of retaining the existing first drywall section in a stable position flush against the horizontal ceiling surface. Furthermore, after installation of the existing first drywall section, each the pivoting brackets is rotated one hundred eighty degrees (180°) such that: (1) the retaining leg is positioned at a second orientation so that the support leg is located beneath the existing first drywall section in a flush manner, and (2) the retaining leg retains an adjacent section of the existing first drywall section flush against the horizontal ceiling surface.

In a non-limiting exemplary embodiment, each of the pivoting brackets includes a pivoting bracket aperture intermediately positioned relative to the retaining leg and the support leg. Such a pivoting bracket aperture passes through the retaining leg and the support leg. A pivoting bracket fastener is removably inserted into the pivoting bracket aperture in such a manner that the pivot bracket is rotated three hundred sixty degrees (360°) about the pivoting bracket fastener while affixed to the existing joist.

In a non-limiting exemplary embodiment, each of the pivoting brackets has a generally rectangular shape and a generally "Z"-shaped cross-section.

In a non-limiting exemplary embodiment, each of the fixed brackets includes a retaining section and a support section integral therewith. In this manner, during installation of the existing second drywall section, the fixed bracket is fastened to the vertical wall surface thereby enabling the retaining section to assist in retaining the existing second drywall second in a desired vertical mounting position. Furthermore, after installation of the existing second drywall section, the fixed brackets are removed and repositioned along the vertical wall surface to assist in mounting an adjacent section of the existing second drywall section.

In a non-limiting exemplary embodiment, each of the fixed brackets include a fixed bracket aperture located at an offset planar portion of the support section, and a fixed bracket removably inserted into the fixed bracket aperture in such a manner that the fixed bracket is maintained at a stationary position while affixed to the vertical wall surface. Advantageously, the retaining section is gradually indented relative to the offset planar portion of the support section thereby providing a resting portion for the existing second drywall section to set flush against the vertical wall surface.

In a non-limiting exemplary embodiment, each of the fixed brackets has a generally rectangular shape.

A method of installing drywall including the initial step of: providing and removably attaching a plurality of pivoting brackets to existing joists located at a horizontal ceiling surface within an existing structure in such a manner that the pivoting brackets enable a user to install an existing first drywall section at the horizontal ceiling surface. Each pivoting bracket has a single and unitary body. Next, providing and removably attaching a plurality of fixed brackets to existing joists located at a vertical wall surface within the existing structure in such a manner that the fixed brackets enable a user to install an existing second drywall section at the vertical wall surface. Each fixed brackets has a single and unitary body.

The method further includes the steps of: providing and engaging the existing first drywall section with the pivoting brackets; providing and engaging the existing second drywall section with the fixed brackets; fastening the existing first drywall section to the existing joists located at the horizontal ceiling surface; rotating one of the pivoting brackets so that a portion of the one (1) pivoting bracket is flush against the fastened existing first drywall section; removing and fastening the pivoting brackets to existing joists located at another section of the horizontal ceiling surface; fastening the existing second drywall section to the existing joists located at the vertical wall surface; and removing and fastening the fixed brackets to existing joists located at another section of the vertical wall surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | system for installing drywall |
| 12 | ceiling joist |
| 13 | drywall |
| 14 | vertical surface |
| 20 | pivoting bracket |
| 22 | retaining leg |
| 24 | support leg |
| 26 | pivoting bracket aperture |
| 28 | pivoting bracket fastener |
| 30 | fixed bracket |
| 32 | retaining section |
| 34 | support section |
| 36 | fixed bracket aperture |
| 38 | fixed bracket fastener |

DETAILED DESCRIPTION OF THE PREFERRED EMBODIMENT

The best mode for carrying out the invention is presented in terms of its preferred embodiment, herein depicted within FIG. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a system for installing drywall (herein described as the "system") 10, which provides a means for providing a pair of brackets 20, 30 which assist in the installation of drywall 13 by a single installer.

Figure 1:
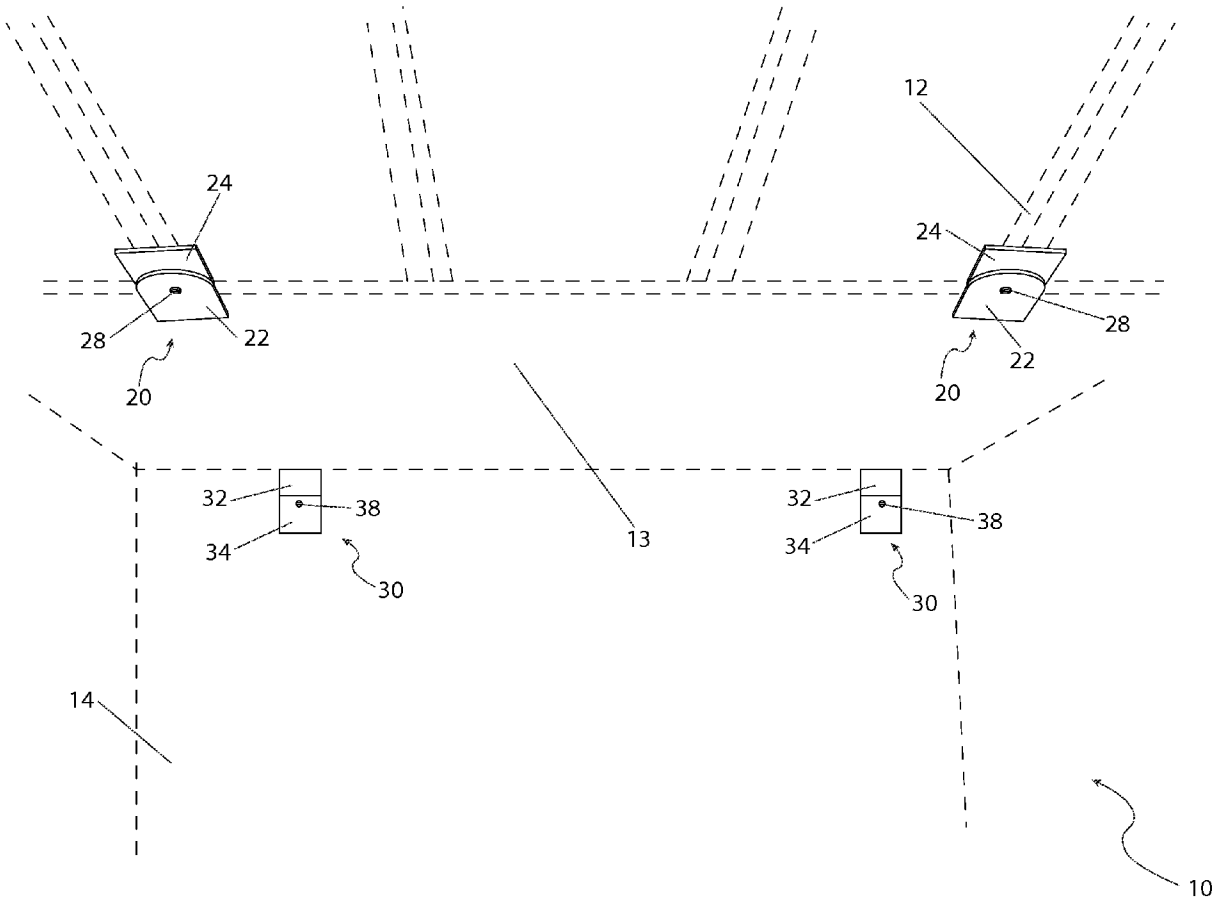
FIG. 1 is an environmental view of a system for installing drywall 10, according to a preferred embodiment of the present invention.

Referring now to FIG. 1, an environmental view of the system 10, according to the preferred embodiment of the present invention, is disclosed. The system 10 comprises a pair of pivoting brackets 20 and a pair of fixed brackets 30. The system 10 enables one (1) installer to mount drywall 13 on a ceiling or other similar vertical surface 14 such as depicted within FIG. 1 which further illustrates a sheet of drywall 13 being installed onto ceiling joists 12. The system 10 utilizes the existing ceiling joists 12 to temporarily attach each pivoting bracket 20 and a vertical surface 14 to temporarily attach each fixed bracket 30. It is known that the fixed brackets 30 may also be attached to the ceiling joists 12 and it is also known that the pivoting brackets 20 may be attached to the vertical surface 14. The system 10 can be utilized with drywall 13, sheet rock, or other similar panel-type coverings utilized to create interior walls and ceilings may be utilized without limiting the scope of the invention.

Figure 2:
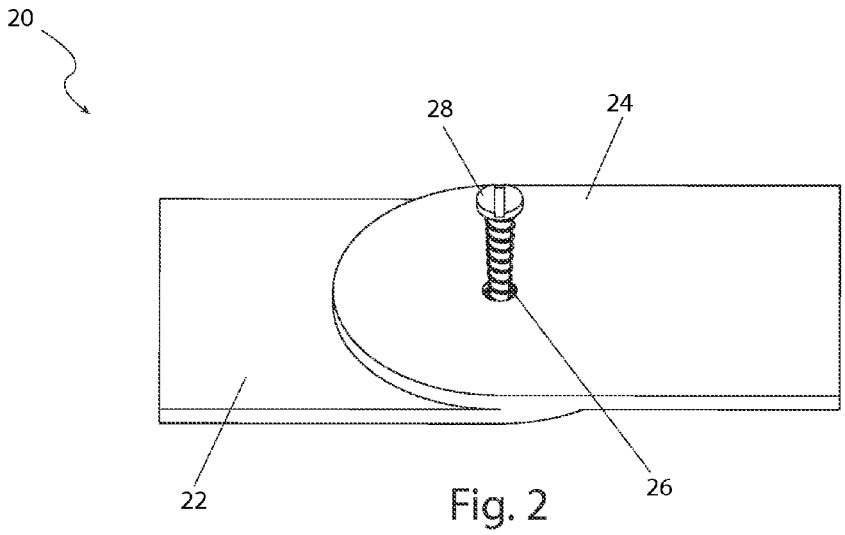
FIG. 2 is a perspective view of a pivoting bracket 20, according to a preferred embodiment of the present invention.
Figure 3:
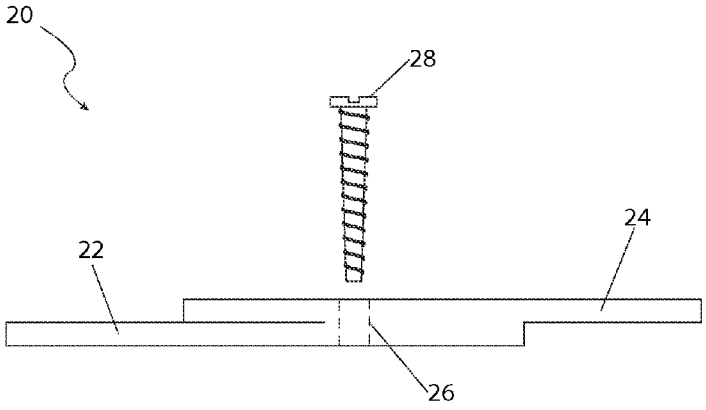
FIG. 3 is a side view of the pivoting bracket 20, according to a preferred embodiment of the present invention.

Referring now to FIG. 2, a perspective view of the pivoting bracket 20 and FIG. 3, a side view of the pivoting bracket 20, according to the preferred embodiment of the present invention, are disclosed. The pivoting brackets 20 comprises a retaining leg 22 and a support leg 24 which are utilized for securing the drywall 13 to the ceiling joist 12. The retaining leg 22 and support leg 24 are integral to the pivoting bracket 20. The pivoting brackets 20 are preferably fabricated from a durable plastic material, yet it is known that other materials may be utilized without limiting the scope of the invention. The pivoting brackets 20 comprise a generally rectangular shape having a generally "Z"-shaped cross-section. The pivoting brackets 20 measure approximately nine inches (9 in.) length and one inch (1 in.) in height, yet it is known that other dimensions which accommodate the space requirements of installing drywall 13 may be utilized. Furthermore, it is understood that the retaining leg 22 and support leg 24 portions may be introduced having different thickness dimensions being suitable for positioning various building materials having corresponding thicknesses such as, but not limited to: one-quarter inch (¼ in.) sheetrock, three-eighths inch (⅜ in.) hardy, five-eighths inch (⅝ in.) siding, five-eighths inch (⅝ in.) plywood, and the like.

The pivoting brackets 20 comprise an intermediately positioned pivoting bracket aperture 26 which enables a countersinking insertion of a pivoting bracket fastener 28. The pivoting bracket fastener 28 is preferably a standard wood screw such as a lag bolt or other similar fastener which fastens to the ceiling joist 12 or vertical surface 14 yet enables the pivoting brackets 20 to rotate three-hundred-sixty degrees (360°). It is also known that the installer may also unscrew the pivoting bracket fastener 28 slightly out of the ceiling joist 12 or vertical surface 14 which would also enable the pivoting bracket 20 to freely rotate.

Figure 4:
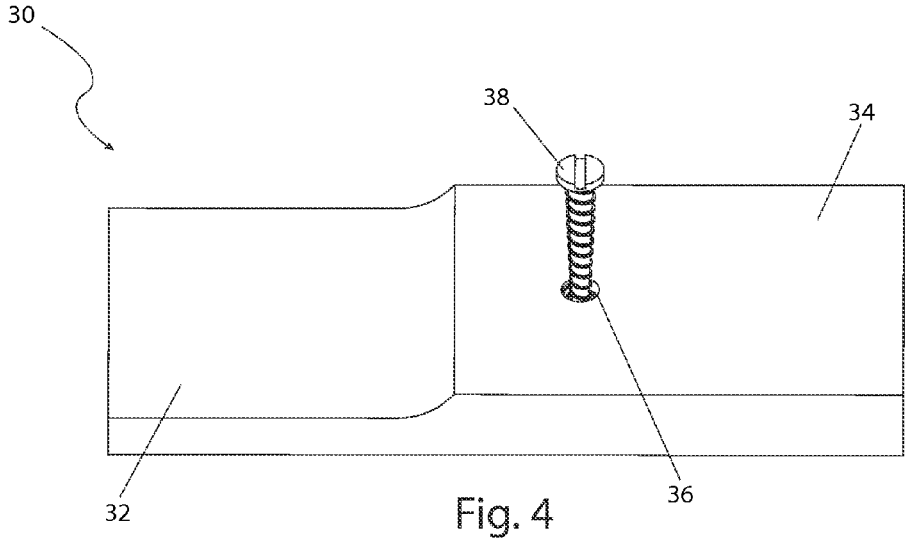
FIG. 4 is a perspective view of a fixed bracket 30, according to a preferred embodiment of the present invention.
Figure 5:
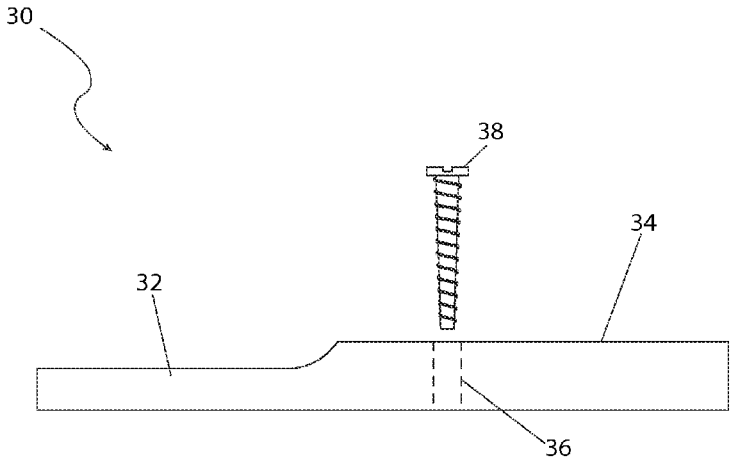
FIG. 5 is a side view of the fixed bracket 30, according to a preferred embodiment of the present invention; and, FIG. 6 is another environmental view of the system for installing drywall 10, according to a preferred embodiment of the present invention.

Referring now to FIG. 4, a perspective view of the fixed bracket 30 and FIG. 5, a side view of the fixed bracket 30, according to the preferred embodiment of the present invention, are disclosed. The fixed brackets 30 also assist the installer in mounting drywall 13 onto a desired surface. The fixed brackets 30 comprise a retaining section 32 and a support section 34 which are utilized to hold the drywall 13 upwardly against the ceiling joist 12 and may also be utilized similarly as the abovementioned pivoting bracket 20. The fixed brackets 30 comprise a generally rectangular shape and similar to the pivoting bracket 20 are fabricated from a durable plastic, yet it is known that other materials may be utilized without limiting the scope of the invention. The fixed bracket 30 measure approximately seven inches (7 in.) in length and one inch (1 in.) in height.

The fixed brackets 30 comprise a retaining section 32 and a support section 34 which are integral portions of the fixed bracket 30 to assist in retaining the drywall 13 It is known that the fixed brackets 30 are to be utilized in conjunction with the pivoting brackets 20. The retaining section 32 is slightly and gradually indented into the fixed bracket 30, thereby providing a resting portion for the drywall 13 to set flush against the desired mounting surface when utilized in a supporting manner. The retaining section 32 is also utilized to provide a stable footing beneath the drywall 13. The support section 32 is utilized to secure the fixed bracket 30 into the ceiling joist 12 or the vertical surface 14. The retaining section 32 may also be utilized to support the drywall 13 against the ceiling joist 12 similar to the pivoting bracket 20. A fixed bracket aperture 36 is located at a slightly offset portion of the support section 34. The fixed bracket aperture 36 enables insertion of a fixed bracket fastener 38 which is preferably a common wood screw which can temporarily secure the fixed bracket 30 on the desired surface.

Figure 6:
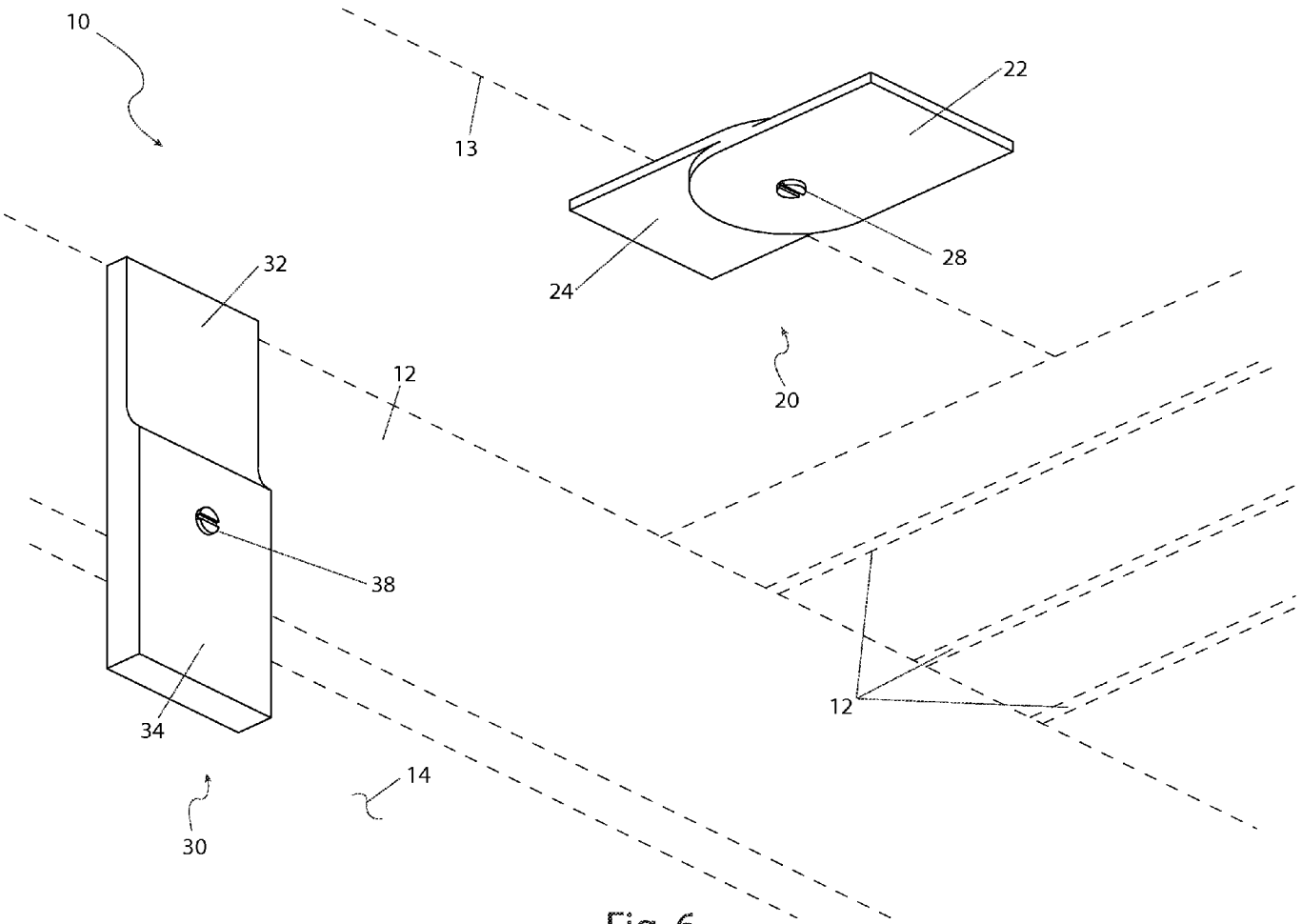

Referring now to FIG. 6, another environmental view of the system 10, according to the preferred embodiment of the present invention, is disclosed. FIG. 6 depicts drywall 13 installed upon the ceiling joist 12. When drywall 13 is being installed, the retaining leg 22 of the pivoting brackets 20 retains said drywall 13 in a stable position flush against the ceiling joist 12 (or vertical surface 14). This position enables the installer to fasten the drywall 13 into position in a normal fashion. Once the drywall 13 has been fastened appropriately the pivoting brackets 20 are rotated one-hundred-eighty degrees (180°) (depicted herein) so that the support leg 24 is beneath the previously fastened drywall 13 in a flush manner and the retaining leg 22 is in position to retain an adjacent section of drywall 13. The fixed bracket 30 is fastened against the vertical surface 14 (depicted herein), thereby enabling the retaining section 32 to assist in retaining the drywall 13 in the desired mounting position. It is known that once the drywall 13 is fastened into the desired position that the fixed brackets 30 are removed and replaced to assist in mounting adjacent section of drywall 13.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of installing and utilizing the system 10 may be achieved by performing the following steps: acquiring the system 10; attaching the fixed brackets 30 onto a desired mounting surface such as a vertical surface 14 or other similar surface via inserting a fixed bracket fastener 38 into the fixed bracket aperture 36 and furthermore into the desired mounting surface; attaching the pivoting bracket 20 onto the desired mounting surface such as ceiling joist 12 at appropriate distances to retain the drywall 13; placing the drywall 13 onto the retaining section 32 on the fixed brackets 30 and onto the retaining legs 22 on the pivoting brackets 20; fastening the drywall 13 in a normal manner upon the ceiling joist 12 or other mounting surface; rotating the pivoting bracket 30 so that the support leg 34 is flush against the fastened drywall 13; replacing the brackets 20, 30 on another location for additional mounting of drywall 13 as desired; removing the brackets 20, 30 as desired; and, utilizing the system 10 to install drywall 13 in a quick and easy manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A method of installing drywall comprising the steps of:

providing and removably attaching a plurality of pivoting brackets to existing joists located at a horizontal ceiling surface within an existing structure, wherein said pivoting brackets enable a user to install an existing first drywall section at the horizontal ceiling surface, wherein each of said pivoting brackets has a single and unitary body, each comprising a retaining leg and a support leg integral therewith;

providing and removably attaching a plurality of fixed brackets to existing joists located at a vertical wall surface within the existing structure, wherein said fixed brackets enable a user to install an existing second drywall section at the vertical wall surface, wherein each of said fixed brackets has a single and unitary body;

providing and engaging the existing first drywall section with said pivoting brackets wherein said retaining leg is positioned at a first orientation capable of retaining an existing first drywall section in a stable position flush against the horizontal ceiling surface;

providing and engaging an existing second drywall section with said fixed brackets;

fastening the existing first drywall section to the existing joists located at the horizontal ceiling surface;

rotating one of said pivoting brackets so that said retaining leg is positioned at a second orientation so that said support leg is located beneath the existing first drywall section in a flush manner;

removing and fastening said pivoting brackets to existing joists located at another section of the horizontal ceiling surface;

fastening the existing second drywall section to the existing joists located at the vertical wall surface; and, removing and fastening said fixed brackets to existing joists located at another section of the vertical wall surface.

2. A drywall installation system comprising:

a plurality of pivoting brackets removably attached to existing joists located at a horizontal ceiling surface within an existing structure; and, a plurality of fixed brackets attached to existing joists located at a vertical wall surface within the existing structure;

wherein said pivoting brackets are used to install an existing first drywall section at the horizontal ceiling surface;

wherein each of said pivoting brackets comprises a retaining leg and a support leg integral therewith;

wherein, during installation of the existing first drywall section, said retaining leg is positioned at a first orientation capable of retaining the existing first drywall section in a stable position flush against the horizontal ceiling surface;

wherein, after installation of the existing first drywall section, each of said pivoting brackets is rotated 180 degrees such that:

said retaining leg is positioned at a second orientation so that said support leg is located beneath the existing first drywall section in a flush manner, and, said retaining leg is capable of retaining an adjacent section of the existing first drywall section flush against the horizontal ceiling surface; and, wherein said fixed brackets are used to install an existing second drywall section at the vertical wall surface.

3. The drywall installation system of claim 2, wherein each of said pivoting brackets further comprises:

a pivoting bracket aperture intermediately positioned relative to said retaining leg and said support leg, said pivoting bracket aperture passing through said retaining leg and said support leg; and, a pivoting bracket fastener removably inserted into said pivoting bracket aperture in such a manner that said pivot bracket is rotated 360 degrees about said pivoting bracket fastener while affixed to one of said existing joists.

4. The drywall installation system of claim 2, wherein each of said pivoting brackets has a generally rectangular shape and a generally "Z"-shaped cross-section.

5. The drywall installation system of claim 2, wherein each of said fixed brackets comprises:

a retaining section and a support section integral therewith;

wherein, during installation of the existing second drywall section, said fixed bracket is capable of being fastened to the vertical wall surface thereby enabling said retaining section to assist in retaining the existing second drywall section in a desired vertical mounting position;

wherein, after installation of the existing second drywall section, said fixed brackets are capable of being removed and repositioned along the vertical wall surface to assist in mounting an adjacent section of the existing second drywall section.

6. The drywall installation system of claim 5, wherein each of said fixed brackets further comprises:

a fixed bracket aperture located at an offset planar portion of said support section; and, a fixed bracket fastener removably inserted into said fixed bracket aperture in such a manner that said fixed bracket is maintained at a stationary position while affixed to the vertical wall surface;

wherein said retaining section is gradually indented relative to said offset planar portion of said support section thereby providing a resting portion for the existing second drywall section to set flush against the vertical wall surface.

7. The drywall installation system of claim 2, wherein said each of said fixed brackets has a generally rectangular shape.

8. A drywall installation system comprising:

a plurality of pivoting brackets removably attached to existing joists located at a horizontal ceiling surface within an existing structure; and, a plurality of fixed brackets removably attached to existing joists located at a vertical wall surface within the existing structure;

wherein said pivoting brackets enable a user to install an existing first drywall section at the horizontal ceiling surface;

wherein each of said pivoting brackets comprises a retaining leg and a support leg integral therewith;

wherein, during installation of the existing first drywall section, said retaining leg is positioned at a first orientation capable of retaining the existing first drywall section in a stable position flush against the horizontal ceiling surface;

wherein, after installation of the existing first drywall section, each of said pivoting brackets is rotated 180 degrees such that:

said retaining leg is positioned at a second orientation so that said support leg is located beneath the existing first drywall section in a flush manner, and, said retaining leg is capable of retaining an adjacent section of the existing first drywall section flush against the horizontal ceiling surface;

wherein said fixed brackets are used to install an existing second drywall section at the vertical wall surface;

wherein each of said pivoting brackets has a single and unitary body; and, wherein each of said fixed brackets has a single and unitary body.

9. The drywall installation system of claim 8, wherein each of said pivoting brackets further comprises:

a pivoting bracket aperture intermediately positioned relative to said retaining leg and said support leg, said pivoting bracket aperture passing through said retaining leg and said support leg; and, a pivoting bracket fastener removably inserted into said pivoting bracket aperture in such a manner that said pivot bracket is rotated 360 degrees about said pivoting bracket fastener while affixed to one of said existing joists.

10. The drywall installation system of claim 9, wherein each of said pivoting brackets has a generally rectangular shape and a generally "Z"-shaped cross-section.

11. The drywall installation system of claim 10, wherein each of said fixed brackets comprises:

a retaining section and a support section integral therewith;

wherein, during installation of the existing second drywall section, said fixed bracket is capable of being fastened to the vertical wall surface thereby enabling said retaining section to assist in retaining the existing second drywall section in a desired vertical mounting position; and, wherein, after installation of the existing second drywall section, said fixed brackets are capable of being removed and repositioned along the vertical wall surface to assist in mounting an adjacent section of the existing second drywall section.

12. The drywall installation system of claim 11, wherein each of said fixed brackets further comprises:

a fixed bracket aperture located at an offset planar portion of said support section; and, a fixed bracket fastener removably inserted into said fixed bracket aperture in such a manner that said fixed bracket is maintained at a stationary position while affixed to the vertical wall surface;

wherein said retaining section is gradually indented relative to said offset planar portion of said support section thereby providing a resting portion for the existing second drywall section to set flush against the vertical wall surface; surface.

13. The drywall installation system of claim 12, wherein said each of said fixed brackets has a generally rectangular shape.

* * * * *